US006729685B1

(12) United States Patent
Ebalobor

(10) Patent No.: US 6,729,685 B1
(45) Date of Patent: May 4, 2004

(54) FOLDABLE WALL SUPPORTED SEAT

(76) Inventor: Sonny Ebalobor, 9091 Holder St., #16, Cypress, CA (US) 90630

( * ) Notice: Subject to any disclaimer, the term of this patent is extended or adjusted under 35 U.S.C. 154(b) by 0 days.

(21) Appl. No.: 10/425,434

(22) Filed: Apr. 29, 2003

(51) Int. Cl.[7] ..... A47C 9/06
(52) U.S. Cl. ..... 297/14; 297/188.09; 108/48; 108/25; 108/13
(58) Field of Search ..... 297/14, 188.09; 108/48, 25, 90, 13

(56) References Cited

U.S. PATENT DOCUMENTS 4,009,903 A * 3/1977 Manspeaker ..... 297/14 X
4,682,438 A 7/1987 Arrow ..... 43/21.2
4,856,435 A * 8/1989 Larson ..... 108/134
5,185,892 A * 2/1993 Mitchell ..... 297/14 X
5,655,459 A * 8/1997 O'Connor et al. ..... 108/48
5,720,522 A 2/1998 Habeck ..... 297/337
6,155,646 A 12/2000 Sisson ..... 297/451.4
6,161,486 A * 12/2000 Boots ..... 108/48 X

* cited by examiner

*Primary Examiner*—Anthony D. Barfield
(74) *Attorney, Agent, or Firm*—Goldstein Law Offices P.C.

(57) ABSTRACT

A foldable wall supported seat that is rested against a wall at one end and may be used as a seat or to support decorative items. The supported seat has a pair of leg assemblies, a pair of U brackets, a seat surface, and a wall bumper. The leg assemblies are pivotally attached to the seat in order to allow the legs to be stowed beneath and parallel to the seat and lowered, perpendicular to the seat when the seat is in use. When the legs are lowered, the wall bumper is pressed against the wall to support a user thereupon.

13 Claims, 5 Drawing Sheets

FOLDABLE WALL SUPPORTED SEAT

BACKGROUND OF THE INVENTION

The invention relates to a foldable wall supported seat. In particular, the invention is a seat that is rested against a wall at one end and has a pair of foldable legs at the opposite end to support the seat in a horizontal position. When not in use, the legs are collapsed beneath the seat for storage.

Additional seats are often needed in many households, especially when a person is entertaining guests. Folding chairs are typically used to provide seats for guests. When not in use, the folding chairs are preferably stored in a closet or other area out of sight. This can cause a problem for those with limited storage space.

Thus, there exists a need for a foldable wall supported seat. The seat is rested against a wall at one end and has a pair of legs at the opposite end, said legs being foldable beneath the seat. When an extra seat is needed, the seat portion is raised to a horizontal position and the legs are lowered thereby providing a place for a person to sit. After use, the legs may be raised and stowed beneath the seat portion, and the seat position is itself lowered and placed flush against the wall, thus eliminating the need for storing extra folding chairs. Additionally, the seat top surface may be removed, revealing a table surface on which snacks and drinks may be rested, or used as a surface for placing decorative items, such as plants, pictures, or candles.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved foldable wall supported seat. As such, the general purpose of the present invention, which will be described subsequently in greater detail, is to provide a new and improved foldable wall supported seat which has all the advantages of the prior art and none of the disadvantages.

To attain this, the present invention essentially comprises a foldable wall supported seat that is rested against a wall at one end and may be used as a seat or to support decorative items. The supported seat has a pair of leg assemblies, a pair of U brackets, a seat surface, and a wall bumper. The leg assemblies are pivotally attached to the seat in order to allow the legs to be selectively stowed beneath and parallel to the seat, and selectively lowered perpendicular to the seat when the seat is in use. The wall bumper is pressed against the wall where the seat is supported at an opposite end by the leg assemblies to maintain the seat surface in the horizontal position.

It is an object of the invention to produce a foldable wall supported seat that eliminates the need to store folding chairs while providing an additional chair. Accordingly, the seat is configured to fold flush against the wall when not in use.

It is a further object of the invention to produce a foldable wall supported seat that may serve as a table surface. Accordingly, the seat top surface may be removed to reveal a table surface on which items may be rested.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
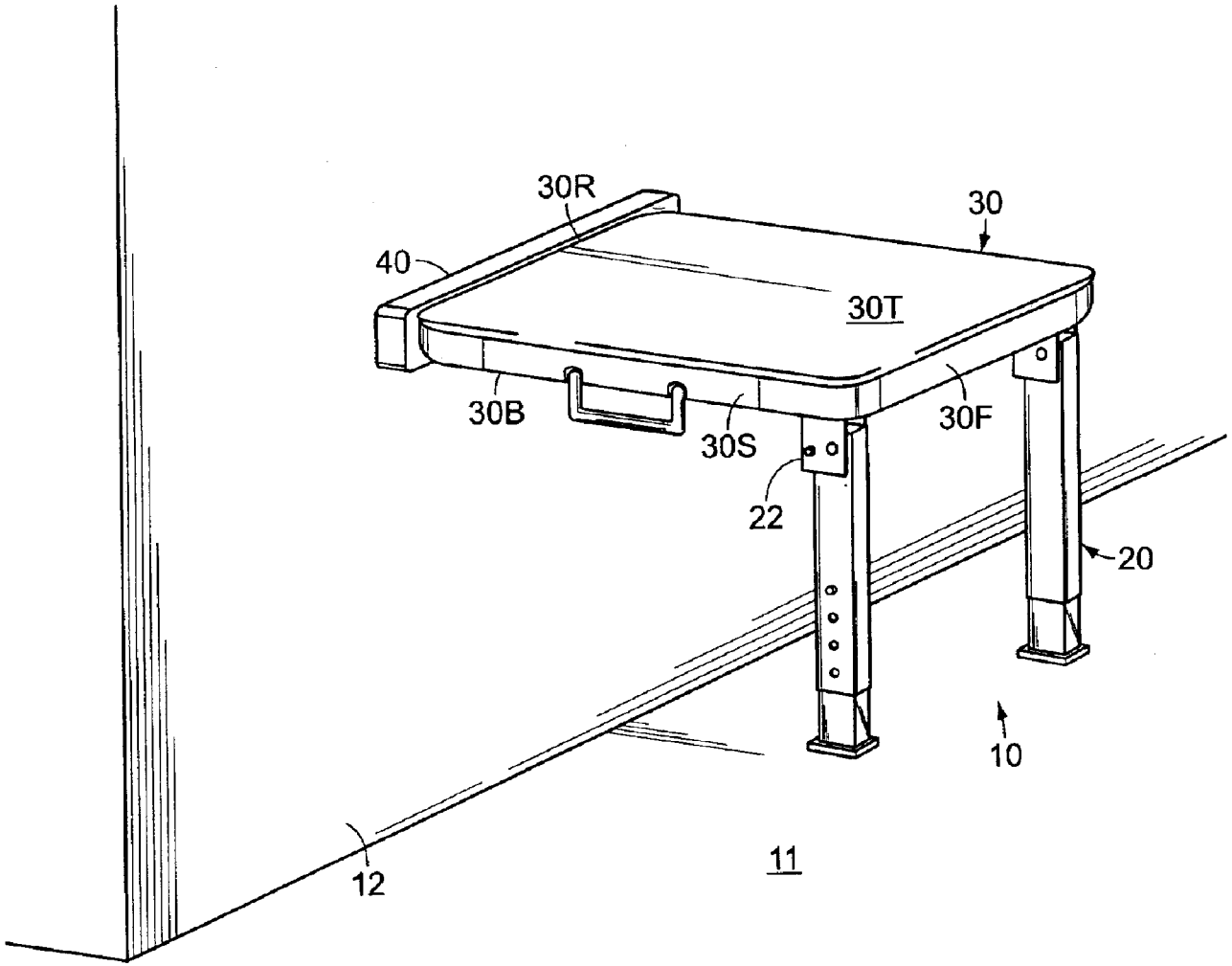
FIG. 1 is a diagrammatic perspective view, illustrating the invention, per se, wherein the seat is in the raised position, and the legs are lowered perpendicular to the seat to support the same.

10 foldable wall supported seat
11 floor surface
12 wall
20 leg assembly
22 U bracket
24 sleeve
24U sleeve upper end
24L sleeve lower end
26 leg portion
26U leg upper end
26L leg lower end
26B leg bottom edge
27 leg push button
28 sleeve aperture
29 foot
29U foot underside
29G foot grip
30 seat surface
30T seat surface top surface
30B seat surface bottom surface
30F seat surface forward edge
30R seat surface rearward edge
30S seat surface side
30U seat top surface underside
32 seat padding
34 handle
36 hinge
40 wall bumper
40F wall bumper rear side
40R wall bumper front side
50 first bracket hole
52 second bracket hole
54 pivot pin hole
56 stop pin

58 pivot pin
60 table surface
62 grip sections
64 cup well
66 table surface notch
68 protrusions

DETAILED DESCRIPTION OF THE PREFERRED EMBODIMENTS

FIG. 1 illustrates a foldable wall supported seat 10 that is supported against a wall 12 in a building or house and may be used as a seat or to support various objects. The supported seat 10 essentially comprises a pair of leg assemblies 20, a pair of U brackets 22, a seat surface 30, and a wall bumper 40, wherein the wall bumper 40 horizontally engages the wall 12 with the seat 10 and the leg assemblies 20 pivot downward about the U brackets 22, perpendicular to the seat surface 30 to engage a floor surface 11 therebeneath and maintain said seat surface 30 in a horizontal position.

The seat surface 30 has a top surface 30T, a bottom surface 30B, a forward oriented edge 30F, a rearward oriented edge 30R, and a pair of opposed sides 30S extending between the top and bottom surfaces 30T, 30B and between the forward and rearward edges 30F, 30R. Padding 32 extends over the seat top surface 30T providing cushioning to a user when sitting thereon. The pair of leg assemblies 20 and the U brackets 22 are positioned near the forward edge 30F of the seat 30, as will be described in greater detail hereinafter, in order to maintain the seat surface 30 in a horizontal position. Further, a handle 34 is attached to one of the seat sides 30S, said handle 34 providing a means for carrying the seat 10 when not in use.

Figure 4:
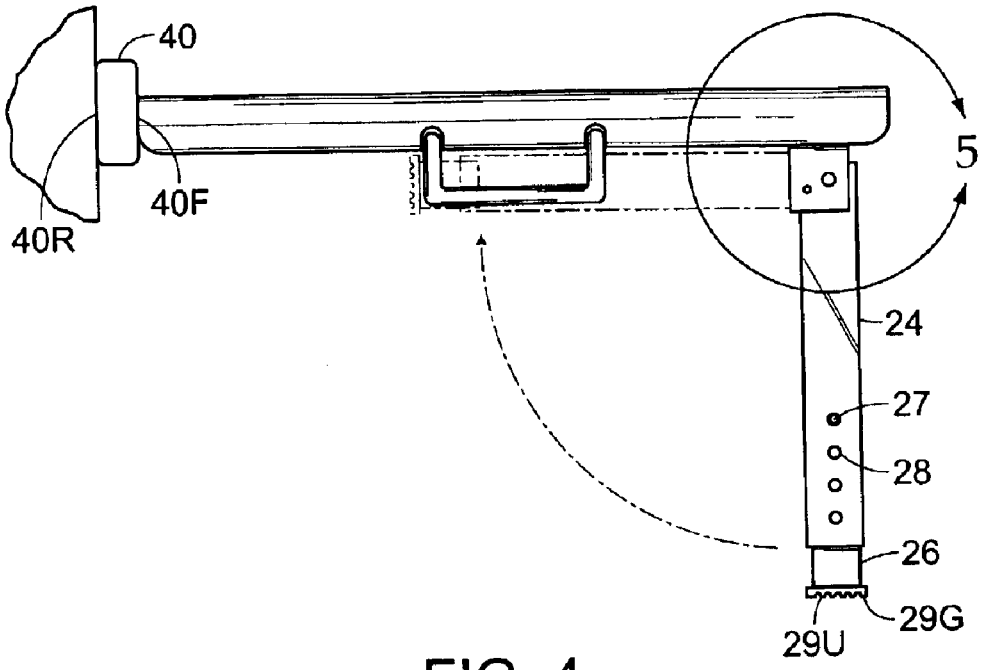
FIG. 4 is a side elevational view of the invention, illustrating the pivotal attachment of the leg assemblies to the seat portion with the U-brackets.

Referring to FIG. 4, each leg assembly 20 comprises a sleeve 24, and a leg portion 26. The sleeve 24 has an upper end 24U and a lower end 24L, whereby the upper end 24U is fastened to the U bracket 22 and the leg portion 26 is inserted into the lower end 24L and extends upward therein. The sleeve 24 is pivotable within the bracket 22, thereby allowing the leg assembly to fold upward and lie parallel to the seat bottom surface 30B, or alternatively to extend downward substantially perpendicular to the seat surface 30.

Figure 5:
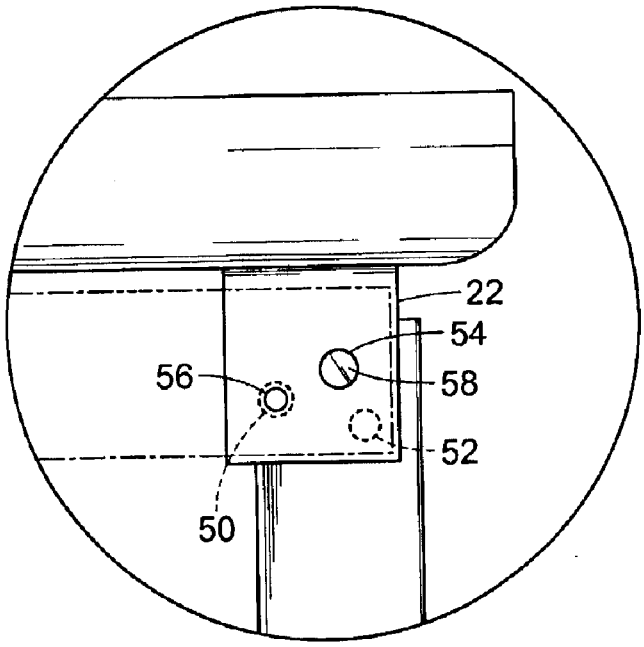
FIG. 5 is an enlarged side elevational view, taken generally in the area of circle 5 in FIG. 4, detailing the interconnection of one of the leg assemblies with one of the U-brackets, and the alternate perpendicular and parallel positions of the leg assemblies therein.
Figure 6:
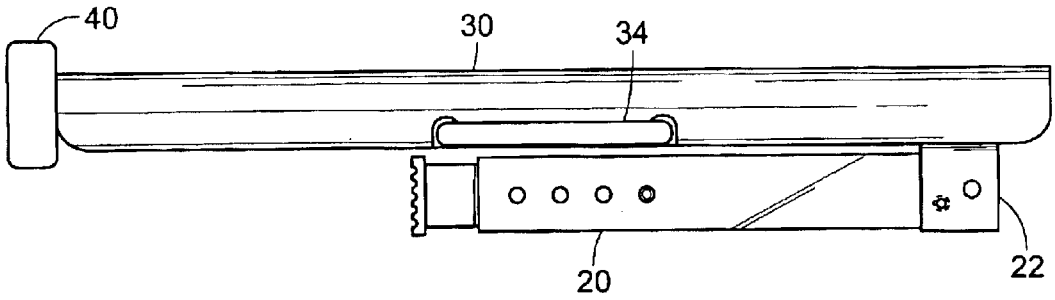
FIG. 6 is a side elevational view, wherein the leg assemblies have been folded beneath and parallel to the seat assembly.

An enlarged view of the U bracket 22 is illustrated in FIG. 5. The sleeve 24 has a plurality of position locking apertures at the upper end 24U that when selectively engaged by the U bracket 22, enable the leg assembly 20 to be locked in raised and lowered positions thereabout. A pivot pin 58 extends through the pivot pin hole 54 and selectively engages the sleeve upper end 24U. The leg assembly 24 pivots about the pivot pin 58, thereby allowing the leg assembly 20 to be raised or lowered thereabout. The apertures comprise a first bracket hole 50, a second bracket hole 52, and a pivot pin hole 54. The first bracket hole 50 and second bracket hole 52 are located at the same radial distance from the pivot pin hole 54, and are located 90° apart on an arc therearound. A stop. pin 56 selectively extends through the first bracket hole 50 and selectively engages the upper end 24U of the sleeve 24 when the leg assembly 20 is in the lowered position, perpendicular to the seat. As illustrated, the stop pin 56 in the first bracket hole 50 immobilizes the leg assembly 20 from raising upward. A stop pin 56 extends through the bracket 22 at the same radial distance from the pivot pin hole 54 as the first and second bracket holes 50, 52 and may also be inserted through the second bracket hole 52, thereby selectively engaging the sleeve upper end 24U and immobilizing the leg assembly 20 in the raised position, parallel to the seat. The stop pin 56 in the second bracket hole 52 maintains the leg assembly 20 in a raised position and prevents the leg 20 from being lowered. The stop pins 56 are spring loaded in the U bracket 22 and fasten said sleeve 24 to the bracket 24 according to the desired position.

Each leg portion 26 has an upper end 26U, a lower end 26L, and a bottom edge 26B, whereby the upper end 26U is inserted into the sleeve lower end 24L. The sleeve lower end 24L has a plurality of sleeve apertures 28 arranged in a column. The leg upper end 26U has a push button 27 that is selectively mateable with one of the sleeve apertures 28, thereby allowing the overall length of the leg assembly 20 to be adjusted and ultimately allowing the height of the seat surface 30 to be adjusted. Further, each leg portion 26 has a foot 29 attached to the leg bottom edge 26B, said foot 29 having an underside 29U that is rested upon a ground surface. The underside 29U may have grips 29G to increase friction with the ground surface and prevent unintentional movement of the leg assemblies 20.

Figure 3:
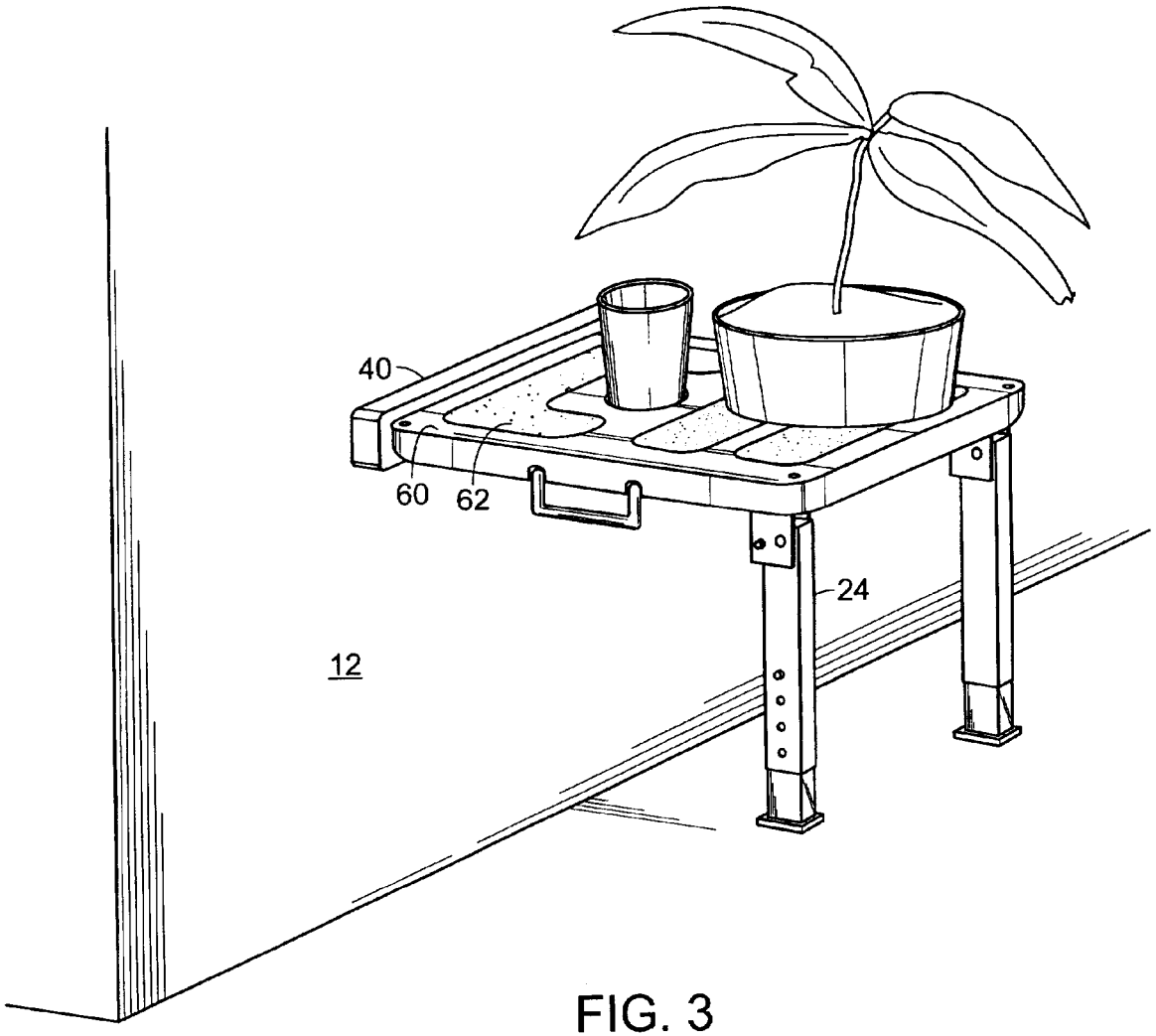
FIG. 3 is a diagrammatic perspective view, similar to FIG. 2, wherein the seat padding has been fully removed, and the table surface is being used to support various objects.

As illustrated in FIG. 3, the seat top surface 30T may be removable in order to expose a table surface 60 thereunder. The table surface 60 may have a plurality of grip sections 62, as well as at least one cup well 64. This surface 60 provides a place for resting various items such as snacks and beverages, as well as decorative items, as illustrated in FIG. 3. Notches 66 are positioned at each corner of the table surface 60. The notches 66 are selectively mateable with protrusions 68 extending downwardly from the underside 30U of the seat top surface 30T. Thus, in use; the seat top surface 30T may be kept in place in order to provide a seat. Alternatively, the seat top surface 30T is removed to reveal the table surface 60.

Figure 2:
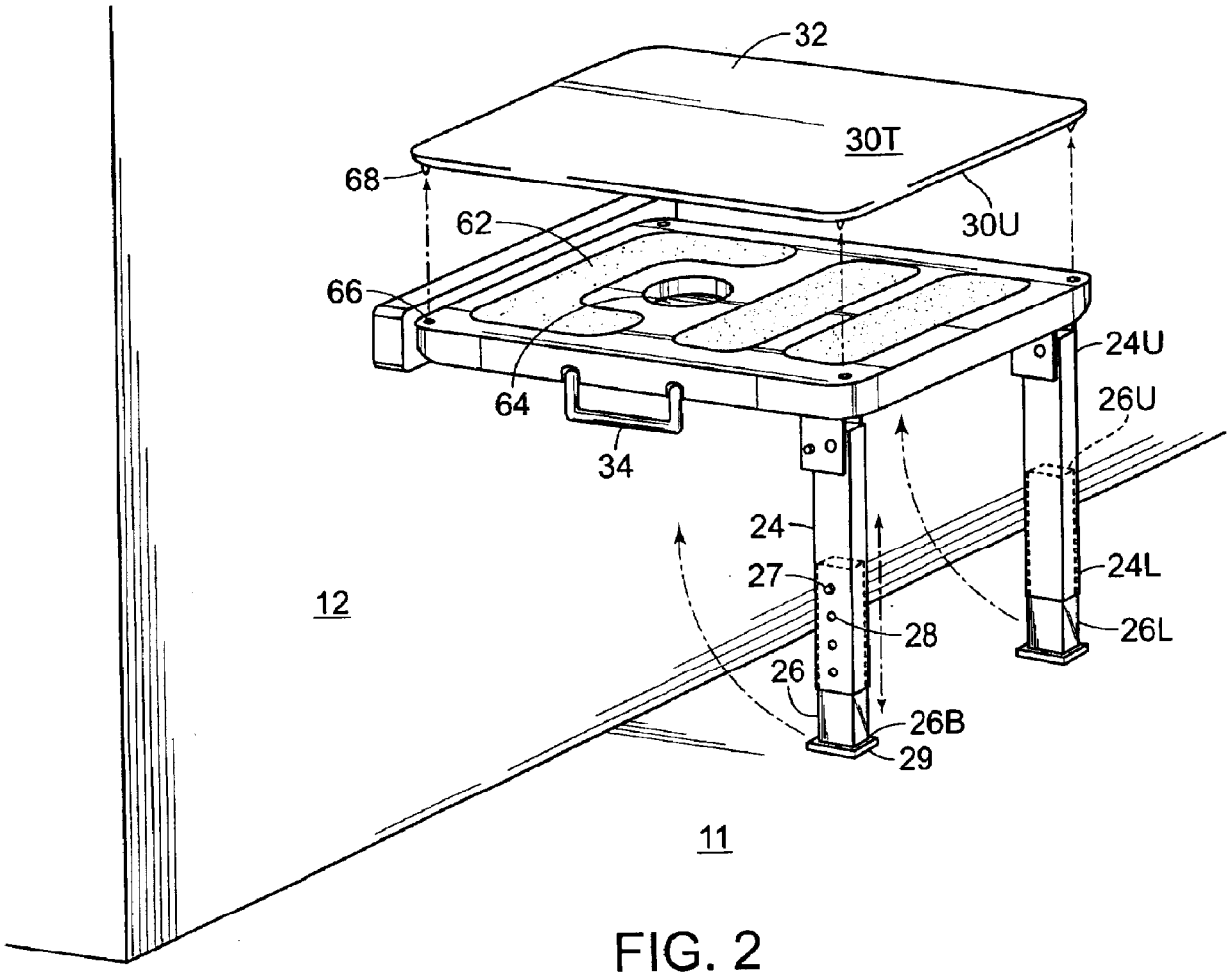
FIG. 2 is a diagrammatic perspective view, similar to FIG. 1, except wherein the seat padding is being removed to reveal the table surface therebeneath.

Referring to FIG. 2, the wall bumper 40 is secured between the seat rearward edge 30R and the wall 12. The wall bumper 40 has a front side 40F and a rear side 40R, wherein when in use the front side 40F is adjacent to the seat 30 and the rear side 40R engages the wall 12. The wall bumper 40 may be constructed from a rubber material in order to protect the wall 12 from damage caused by the wall bumper 40 being pressed thereagainst. Further, the rubber material increases the friction between the wall bumper 40 and the wall 12 to prevent unintentional movement of the seat 10.

In use, a position is chosen on a wall 12 whereabout the foldable wall supported seat 10 is to be rested against. The leg assemblies 20 are pivoted downward, perpendicular to the seat bottom surface 30B. The wall bumper rear surface 40R is then pressed against the wall 12, thereby supporting the seat 10 thereagainst. The leg assembly feet 29 are rested upon the ground surface, thereby supporting the seat 30 in a horizontal position. In order to adjust the height of the seat 30, the leg portions 26 are adjusted within the sleeves 24 by repositioning the leg push buttons 27 in a lower or higher aperture 28 along the sleeve lower end 24L. A person is then free to sit upon the seat padding 32. Alternatively, the seat top surface 30T may be removed from the seat bottom surface 30B by raising same upward therefrom, thereby revealing the table surface 60.

When the seat surface 30 or table surface 60 are not in use, the stop pins 56 are pulled outward and the leg assembly sleeves 24 are pivoted about the pivot pins 58 in the U brackets 22 and the leg assemblies 24 are raised upward substantially parallel to the seat bottom surface 30B at which point the stop pins 56 are released to engage the second attachment holes 52. The seat 10 may then be removed from the wall 12 and stored for future use. The handle 34 is used to carry the retraceable seat 10.

In conclusion, herein is presented a foldable wall supported seat. The invention is illustrated by example in the drawing figures, and throughout the written description. It should be understood that numerous variations are possible, while adhering to the inventive concept. Such variations are contemplated as being a part of the present invention.

What is claimed is:

1. A foldable wall supported seat that is rested against a wall and upon a floor surface, the seat comprising:

a seat surface, the seat surface having a top surface, a bottom surface, a forward oriented side edge, a rearward oriented side edge, and a pair of opposed sides extending between the forward and rearward side edges;

a pair of leg assemblies, each leg assembly positioned adjacent to the seat forward edge and secured to the seat bottom surface, said leg assemblies selectively extending downward to engage the floor and being collapsible in order to fold the seat;

a wall bumper, the wall bumper attached at the seat rearward edge, said wall bumper having a front side and a rear side, the front side attached to the seat rearward edge, wherein when in use the rear side frictionally engages the wall;

a pair of U brackets, each U bracket positioned between one leg assembly and the seat surface bottom surface near the forward side edge, wherein the leg assemblies each pivot within one of the U brackets to selectively raise and lower the leg assemblies; and a table surface, the table surface being positioned between the seat top surface and the seat bottom surface, whereby the seat top surface is removed to expose the table surface.

2. The foldable wall supported seat as recited in claim 1, wherein the U bracket has a pivot pin hole, and wherein the leg assembly further comprises a pivot pin, the pivot pin selectively extending through the pivot pin hole and selectively engaging the leg assembly, whereby the leg assembly pivots about the pivot pin, thus allowing the leg assembly to be raised and lowered thereabout.

3. The foldable wall supported seat as recited in claim 1, wherein each leg assembly comprising a leg portion and a sleeve portion, the sleeve portion having an upper end and a lower end, and the leg portion having an upper end and a lower end, wherein the leg portion upper end is inserted into the sleeve lower end and extends upward therein.

4. The foldable wall supported seat as recited in claim 3, wherein each sleeve further comprises a first bracket hole and a second bracket hole, each U bracket has a stop pin, whereby the stop pin extends through the first bracket hole and selectively engages the first bracket hole of the leg assembly when the leg assembly is in the lowered position, thus the stop pin in the first bracket hole prevents the leg assembly from raising upward, and whereby a second stop pin also selectively engages the second bracket hole and when the leg assembly is in the raised position, thus the stop pin in the second bracket hole maintains the leg assembly in a raised position and prevents the leg assembly from being lowered.

5. The foldable wall supported seat as recited in claim 4, wherein each sleeve lower end has a plurality of sleeve apertures, and wherein the leg portion further comprises a push button positioned on the leg upper end, whereby the leg push button is selectively mateable with one of the sleeve apertures, thereby enabling the length of the leg assembly to be adjustable.

6. The foldable wall supported seat as recited in claim 5, wherein the leg portion further comprises a leg bottom edge and a foot, the foot attached to the leg bottom edge.

7. The foldable wall supported seat as recited in claim 6, wherein the leg portion foot further comprises an underside that is rested upon a ground surface when the leg assemblies are lowered, the underside having grips.

8. The foldable wall supported seat as recited in claim 1, wherein the table surface comprises four corners, each corner having a notch positioned thereabout, and wherein the seat top surface further comprises an underside, four corners, and a protrusion positioned at each corner along the underside, whereby the protrusions of the seat are mateable with the table surface notches in order to prevent the seat top surface from inadvertently slipping from the table surface when in place thereon.

9. The foldable wall supported seat as recited in claim 8, wherein the table surface comprises at least one grip section.

10. The foldable wall supported seat as recited in claim 8, wherein the table surface comprises at least one cup well.

11. The foldable wall supported seat as recited in claim 1, wherein the seat top surface further comprises padding extending thereover.

12. The foldable wall supported seat as recited in claim 1, wherein the seat surface further comprises a handle for carrying the seat, the handle being attached to one of the seat sides.

13. The foldable wall supported seat as recited in claim 1, wherein the wall bumper is constructed from a rubber material to protect the wall from damage caused by the wall bumper being pressed thereagainst.

* * * * *